United States Patent [19]

Watanabe

[11] Patent Number: 4,961,292

[45] Date of Patent: Oct. 9, 1990

[54] BUILDING STRUCTURE WITH AN ELEVATOR

[76] Inventor: Shin Watanabe, c/o Shin Watanabe, 22-14, Ryoke 7-chome, Urawa-shi, Japan

[21] Appl. No.: 333,233

[22] Filed: Apr. 5, 1989

[30] Foreign Application Priority Data

Jul. 6, 1988 [JP] Japan ..... 63-169759
Aug. 10, 1988 [JP] Japan ..... 63-199096

[51] Int. Cl.[5] ..... F24F 7/00
[52] U.S. Cl. ..... 52/1; 52/236.2
[58] Field of Search ..... 52/236.3, 30, 1, 79.1, 52/79.2, 79.6, 79.7, 79.8, 79.12; 98/42.15

[56] References Cited

U.S. PATENT DOCUMENTS

| | | | |
|---|---|---|---|
| 1,896,734 | 2/1933 | Tullgren | 52/30 |
| 3,388,512 | 6/1968 | Newman | 52/79.12 X |
| 3,541,744 | 11/1970 | Maxwell | 52/79.12 X |
| 3,603,047 | 9/1971 | Tournier | 52/30 |
| 3,744,193 | 7/1973 | Lau | 52/30 |
| 3,951,051 | 4/1976 | Dry | 98/42.15 |
| 3,955,323 | 5/1976 | Harmathy | 98/42.15 X |
| 4,033,246 | 7/1977 | Jentoft | 98/42.15 |
| 4,645,037 | 2/1987 | Gomez | 52/30 X |
| 4,794,747 | 1/1989 | Yendo | 52/236.3 |

FOREIGN PATENT DOCUMENTS

| | | | |
|---|---|---|---|
| 5075040 | 5/1977 | Japan | 98/42.15 |
| 795582 | 5/1958 | United Kingdom | 52/236.3 |

*Primary Examiner*—David A. Scherbel
*Assistant Examiner*—Jerrold D. Johnson
*Attorney, Agent, or Firm*—Fleit, Jacobson, Cohn, Price, Holman & Stern

[57] ABSTRACT

A building structure comprises three sections; a first section having a living area on each floor; a second section having an elevator; a third section having a path connecting the living area and the elevator entrance. The third section has a closable ventilation opening for exhausting smoke when the fire breaks out and closing device for closing the opening means at a normal time.

15 Claims, 9 Drawing Sheets

BUILDING STRUCTURE WITH AN ELEVATOR

BACKGROUND OF THE INVENTION

The invention relates to a building structure with at least an elevator.

FIG. 10 shows a conventional structure of building. On each floor in building 71, there is provided living area 72 which is divided into rooms, halls, corridors etc. if necessary. Elevator 73 passes through elevator shaft 74 and stops at designated floor. Door 76 which is fixed to a side wall of building 71 as an elevator entrance and exit is opened and closed in accordance with door 75 fixed to the elevator 73. Generally, in front of the elevator entrance, there is provided an elevator hall which is connected to each room through a corridor.

As described above, the conventional building has such a structure that elevator door 76 is connected directly to living area 72, accordingly, when a fire breaks out in living area 72 on a floor, the smoke gets into tunnel 74 through door 76 and tunnel 74 acts as if a chimney. In the conventional building, therefore, when a fire breaks out, it is not recommended to use and escape by elevator 73 which passes through tunnel 74 but by the emergency stairs. In a multistory building, however, considerable strength is needed to escape to the 1st floor through the escape stairs and it is almost impossible for the aged and the sick to do so.

FIG. 11 shows another building structure which is adopted in a building in a housing development. On each floor, as shown in the figure, living area 72 is divided into a plurality of independent rooms 72A, 72B etc. which are separated independently from the outdoors respectively. Rooms 72A, 72B have doors 82A, 82B respectively which face on a common corridor 81 leading to the elevator entrance door 76. 83 is a guardrail fixed to the upper end of side wall of corridor 81 for preventing the walkers from falling outdoors from corridor 81 which is connected directly to the outdoors, in other words, which has no upper side walls separating from the outdoors.

In this structure, even if the fire breaks out in one of living areas 72A and 72B, smoke gets away outdoors through the opening of corridor 81 and does not get into tunnel 74.

In this structure, however, since tunnel 74 faces on room 72A through a wall, when the fire breaks out in room 72A and the wall is broken down by the flame and heat, the smoke, burning gas, heat, flame etc. get into tunnel 74. Also, because corridor 81 is open to the weather and has almost the same environment as the outdoors, it is substantially impossible to use corridor 81 as a living area. Accordingly, the conventional structure can not be employed in buildings for the department stores, business offices, companies etc.

SUMMARY OF THE INVENTION

An object of the invention is to solve the problems mentioned above.

Another object of the invention is to provide a building structure wherein many people can escape safely and immediately when a fire breaks out.

According to the invention, there is provided a building structure with at least one elevator comprising a first section having a plurality of floors and at least one living area on each floor in which people work or live, a second section having at least one elevator shaft through which the elevator passes, a third section having at least one path on each floor connecting the living area in the first section and the elevator entrance in the second section so that the first and second sections are connected only through the third section, opening means formed on the walls or ceiling of path so that the path is connected directly to the outdoors, and, closing means which closes the opening means so that the path is not open to weather at a normal time and is opened in case of fire so that the smoke, gas etc. are exhausted from the opening means.

In the invention, because when the fire breaks out, it is able to prevent the elevator from being smoked, many people can escape safely and immediately through the elevator.

DETAILED DESCRIPTION OF THE PREFERRED EMBODIMENTS

Figure 1:
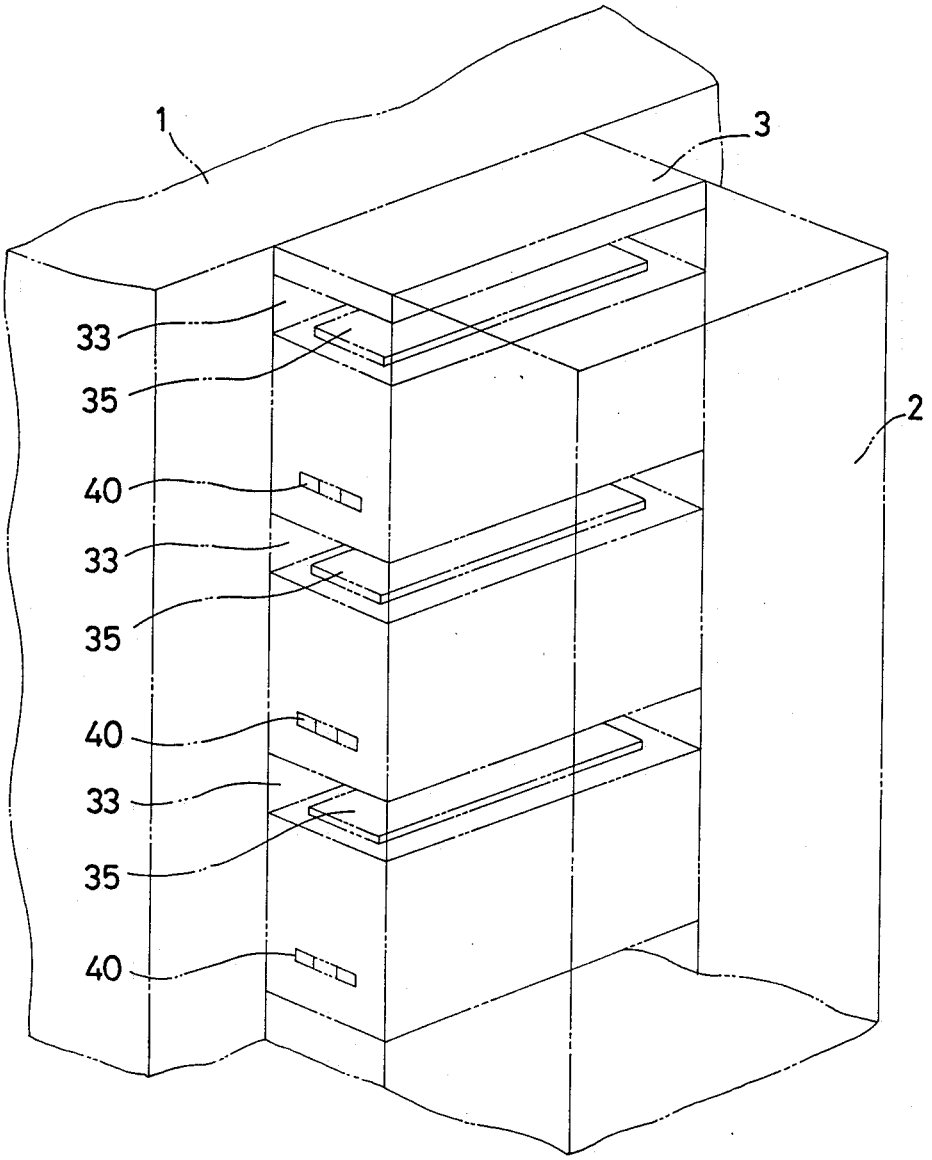
FIG. 1 is a perspective view of a building structure according to the invention.
Figure 2:
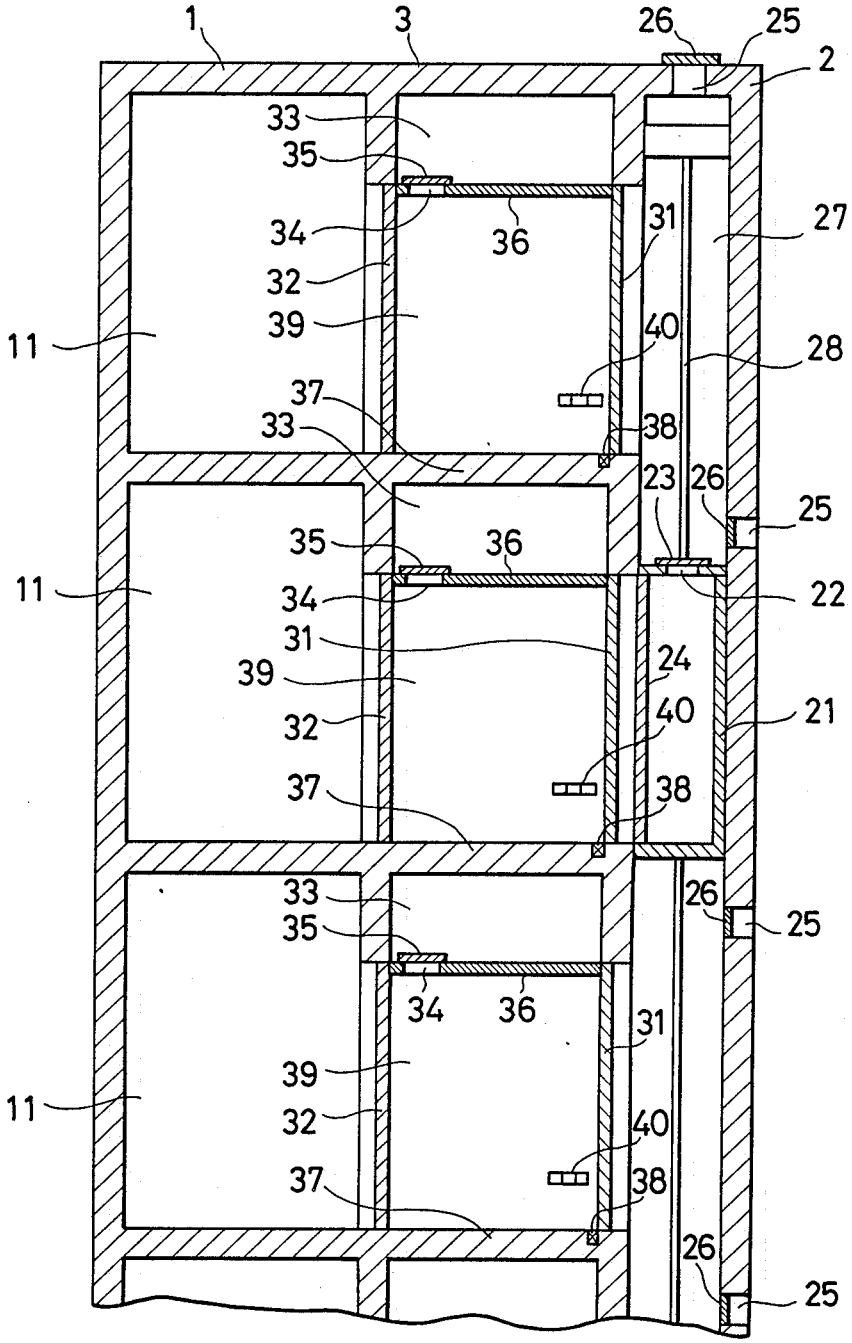
FIG. 2 is a cross-sectional drawing of a building structure according to the first embodiment of the invention.

FIGS. 1 and 2 show a building structure according to the invention. In the invention, a building comprises three sections; the first section 1 having living area 11 including rooms, halls, lobbies, corridors etc. on each floor, living area 11 being separated from the outdoors; second section 2 having an elevator shaft 27 through which elevator 21 passes; third section 3 connecting the first and second sections. As shown in FIG. 1, first section 1 is connected to second section 2 only through third section 3. In other words, the left, right and rear walls of second section 2 do not confront first section 1 but the outdoors directly. Furthermore, second section 2 has no living area which is used at a normal time except such an elevator hall as is used in case of using the elevator.

Living area 11 is separated from the outdoors so that it is not open to the weather. Of course, however, living area 11 can have the windows which are able to be opened and closed.

In section 2 elevator 21 moves up and down by being driven through wire 28. On the ceiling of elevator 21 mounted is an exhausting equipment comprising at least opening 22 and lid 23 which closes the opening 22 when a fire does not break out. Also, section 2 has exhausting equipments on the side walls and the ceiling comprising at least openings 25 and lids 26 closing openings 25 at the normal time. The fans which exhaust compulsively the smoke and gas can be added to the exhausting equipments if necessary.

On each floor, section 3 has path 39 connecting living area 11 in section 1 and elevator entrance door 31 in section 2, door 31 being opened and closed in association with door 24 which is fixed to elevator 21. Door 32 can be provided at the 1st section side end of path 39 if necessary. Over ceiling 36 of path 39 there is provided space 33 which is connected directly to the outdoors, in other words, which is open to the weather. On ceiling 36 (or the side walls of path 39) provided is an exhausting equipment comprising opening 34 and lid 35 closing opening 34 and a fan which is added if necessary. Floor 37 of path 39 connects strongly sections 1 and 2 together with the side walls of path 39, and thereby sections 1, 2 and 3 can be in a monolithic construction. Nozzle 38 for forming an air curtain is mounted on floor 37 between opening 34 and door 31 (in this embodiment in the vicinity of door 31). On the side walls of path 39 there are provided relatively small windows 40 which can be opened and closed by hand.

Figure 3:
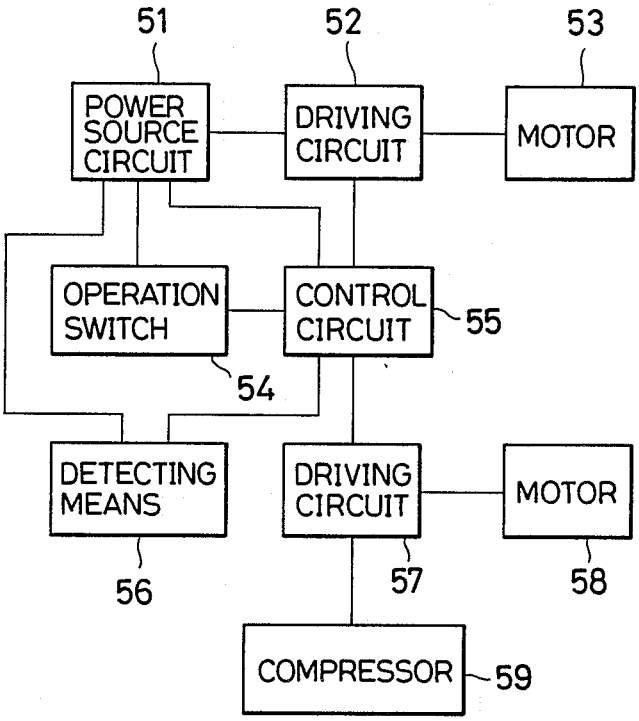
FIG. 3 is a block diagram of a control apparatus for controlling an elevator according to the invention.

FIG. 3 is a block diagram of a control apparatus for controlling elevator 21. 51 is a power source circuit supplying electric power necessary for driving elevator 21. Power source circuit 51 is separated from the power source system supplying living area 11 in section 1 with electric power so that even if a fire breaks out in living area 11 and the electric power supply is interrupted in section 1, the electric power supply can be maintained in section 2. 52 is a driving circuit driving motor 53 which drives elevator 21. 54 designates operation switches which are set on a wall near the elevator entrance (near door 31 or 32) and on the inner side wall of elevator 21 and are operated for controlling elevator 21. 55 is a control circuit comprising for instance a microcomputer for controlling a drive of elevator 21. 56 is detecting means for detecting the fire by detecting the smoke or heat positioned on each ceiling 36 of path 39 and/or living area 11. 57 is a driving circuit driving motor 58 and compressor 59; motor 58 driving lid 35 and compressor 59 compressing an air for generating an air curtain.

At a normal time, according to the operation of switch 54, control circuit 55 drives motor 53 through driving circuit 52 so that elevator 21 moves up or down from a floor to the designated floor.

When a fire breaks out in living area 11 on a floor and the smoke is detected by detecting means 56 positioned on ceiling 36 for example, control circuit 55 drives motor 58 through driving circuit 57. Motor 58 makes lid 35 move and opening 34 open. Accordingly, the smoke, gas, flame, heat etc. got into path 39 are exhausted outdoors through opening 34 and space 33. The length of path 39 and the size of opening 34 are determined so that these smoke, gas etc. can be exhausted sufficiently.

When the fire is detected, compressor 59 is driven at the same time and a jet of compressed air is sent up from nozzle 38 and an air curtain is formed. Therefore, the smoke, gas etc. are prevented from getting into tunnel 27 through the clearance of door 31 and further into the elevator 21 through the clearance of door 24.

If the smoke is too much and can not be exhausted sufficiently from opening 34, it may get into tunnel 27 and elevator 21. Accordingly, there can be provided the other motors which drive lids 23 and 26. In this case, the smoke in elevator 21 is exhausted outdoors through opening 22, tunnel 27 and opening 25.

Normally, door 32 can be kept open for the sake of getting on and off elevator 21. When the fire breaks out, however, door 32 can be driven according to the movement of door 31. Thereby, it is prevented more effectively that the smoke gets into elevator 21. When the distance between doors 31 and 32 (the length of path 39) is relatively short, doors 31 and 32 can be driven at the same time in accordance with door 24. To the contrary, when the distance is relatively long and relatively many people can get together in path 39, door 32 can be opened and closed by hand separately from the movement of door 31. In this case, people in path 39 can make a judgement of opening and closing door 32 in consideration of circumstances and path 39 can be used as a safety place at the time of fire. Of course, another air curtain can be formed near door 32.

When a little smoke or heat exists in path 39 and path 39 is stuffy, people evacuees can open windows 40 if necessary.

Thus at the time of fire, many people can escape safely through elevator 21 by operating switches 54.

Also since an air layer comprising space 33 and path 39 between sections 1 and 2 acts as a safety wall, section 2 is protected from the fire.

In case of fire, lids 35 on all of the floors can be opened. When the lids on the floors where there exists no smoke are opened, however, there is a possibility that unexpected accidents occur. Therefore, lids 35 on and above the floor where the fire breaks out, or lids 35 only on a predetermined number of floors (for example 10 floors) including the fire floor can be opened and the others can be kept close.

Figure 4:
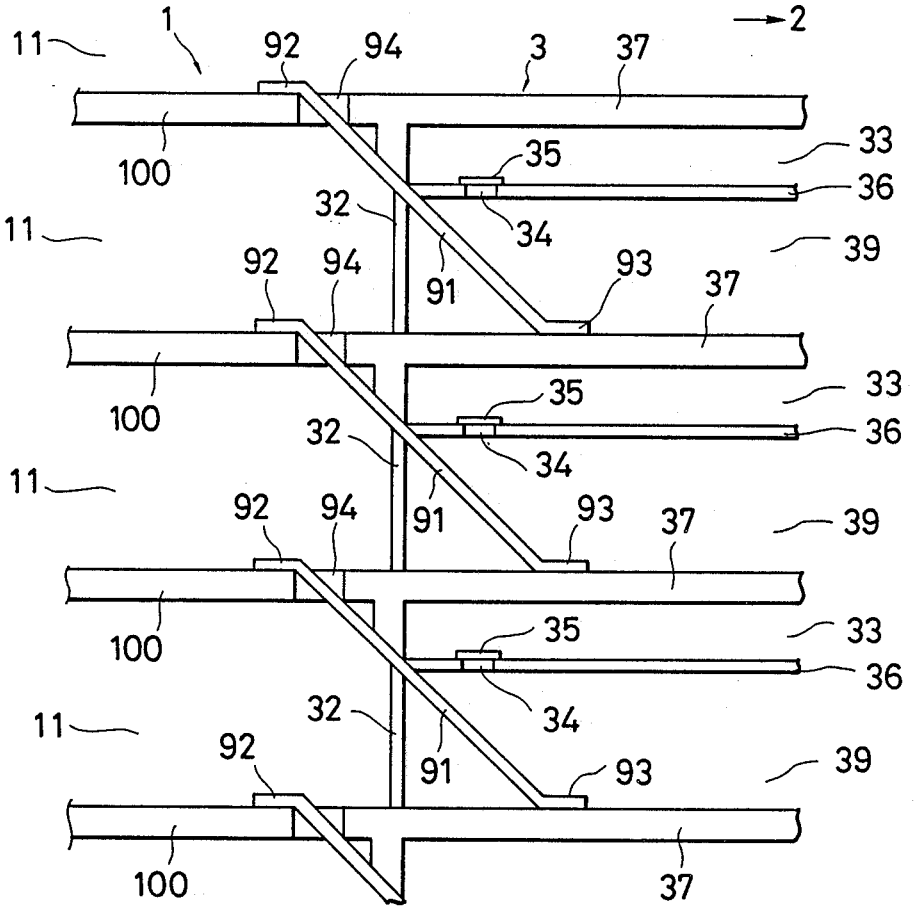
FIG. 4 is a cross-sectional drawing of a building structure according to the second embodiment of the invention.

FIG. 4 shows the second embodiment of the invention which has a structure wherein more people can escape promptly and safely. In the figure, 91 is an escalator connecting an upstairs entrance (or exit) 92 and a downstairs exit (or entrance) 93. Downstairs exit 93 locates in path 39 between opening 34 and section 2. On the other hand upstairs entrance 92 in the embodiment locates in the section 1. 100 designates a floor of living area 11 in section 1 and 94 is a hole on floor 100 for passing through escalator 91.

Figure 7:
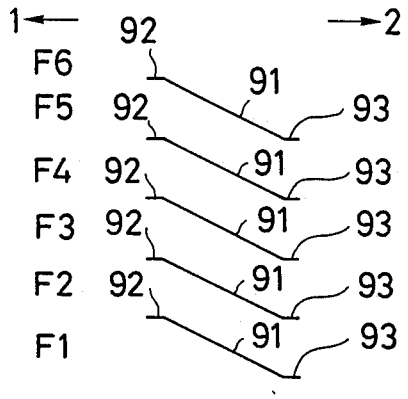
FIG. 7 is an explanatory drawing of an escalator.

As shown typically in FIG. 7, escalator 91 connects upstairs living area 11 in section 1 and downstairs path 39. Therefore, at the time going down for example from the sixth floor to the fourth floor, people get on escalator 91 from entrance 92 on the sixth floor and go down to exit 93 in path 39 on the fifth floor. Furthermore people walk to entrance 92 in living area 11 on the fifth floor, go down by escalator 91 to the fourth floor, and walk to living area 11 from exit 93 on the fourth floor.

Figure 8:
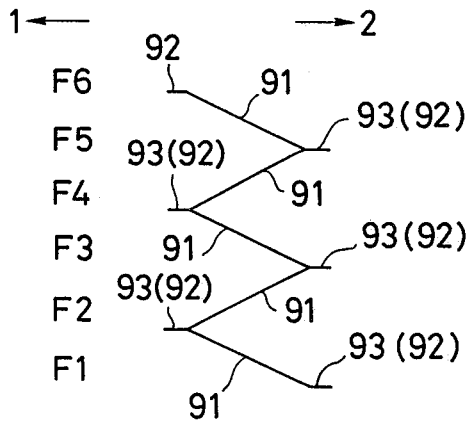
FIG. 8 is an explanatory drawing of an escalator.

As shown in FIG. 8, when escalator 91 connects entrance 92 in section 1 on the sixth floor and exit 93 in path 39 on the fifth floor, for instance, next escalator 91 can be positioned so that entrance 92 in path 39 on the fifth floor and exit 93 in living area 11 on the fourth floor are connected to each other. Since the entrance is positioned near the exit on each floor, the structure has such an advantage that a walking distance between the exit and the entrance can be short. However, the structure has such a disadvantage that when the fire breaks out in living area 11 on the fourth floor for example, the smoke, gas, heat, flame etc. are possibly guided by escalator 91 into upstairs path 39.

On the contrary, in the structure shown in FIG. 7, since the smoke, gas etc. go up usually, there is little possibility that these may get into downstairs path 39. Accordingly, escalator 91 as well as elevator 21 can be used to escape and more people can escape more promptly and safely. Of course, the electric power for escalator 91 is supplied from power source circuit 51.

Escalator 91 can be used at the usual time as well as in case of fire. Since escalators 91 are mainly for the emergency, however, they are positioned as shown in FIGS. 4 and 7. Of course, the other escalators which are positioned in living area 11 mainly for the sake of use at the normal time can be constructed as shown in FIG. 8.

Figure 5:
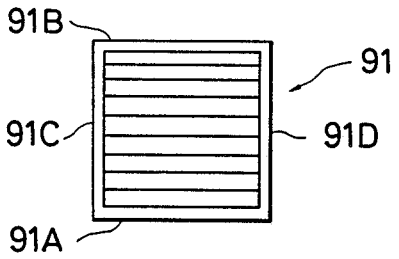
FIG. 5 is a cross-sectional drawing of an escalator according to the invention.

As shown in FIG. 5, the floor 91A, ceiling 91B and left and right side walls 91C and 91D of escalator 91 for emergency can be connected so as to form a tunnel, and thereby escalator 91 is protected from the smoke, gas, flame, heat et.

Figure 6:
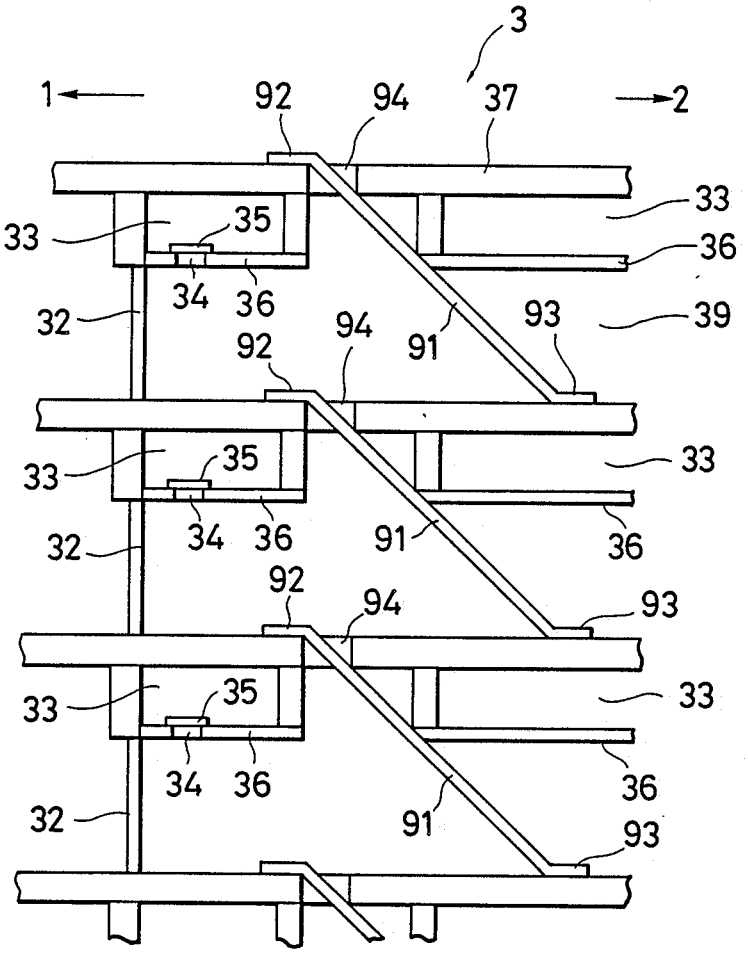
FIG. 6 is a cross-sectional drawing of a building structure according to the third embodiment of the invention.

FIG. 6 shows the third embodiment of the invention. While in FIG. 4 entrance 92 is positioned in section 1, in FIG. 6 entrance 92 as well as exit 93 are located in path 39 in section 3. When the length of path 39 can be long, by employing the structure shown in FIG. 6 safer escape is made possible. In this case, since both of entrance 92 and exit 93 locate between opening 34 and section 2, escalator 91 is protected from the smoke, gas etc. Accordingly, escalators 91 can be constructed as shown in FIG. 8 as well as in FIG. 7. By constructing as shown in FIG. 8, the walking distance between entrance 92 and exit 93 on each floor can be short and people can escape more immediately.

Figure 9A:
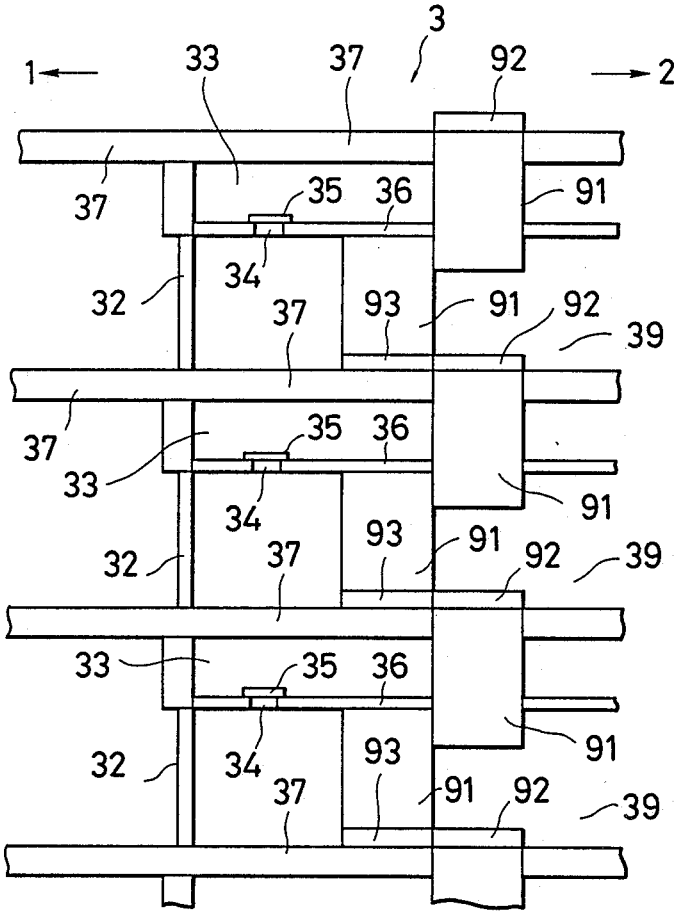
FIG. 9A is a cross-sectional drawing of a building structure of the fourth embodiment of the invention.
Figure 9B:
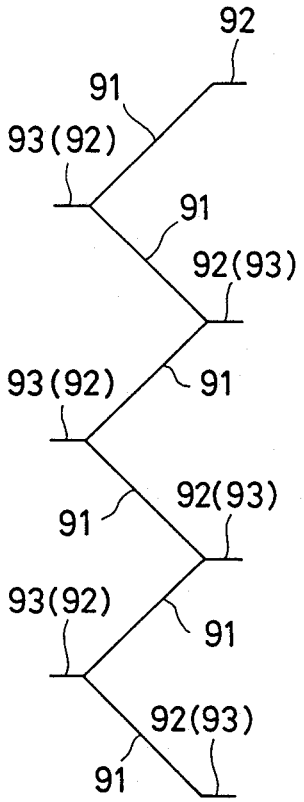
FIG. 9B is an explanatory drawing of an escalator according to the fourth embodiment of the invention.
Figure 10:
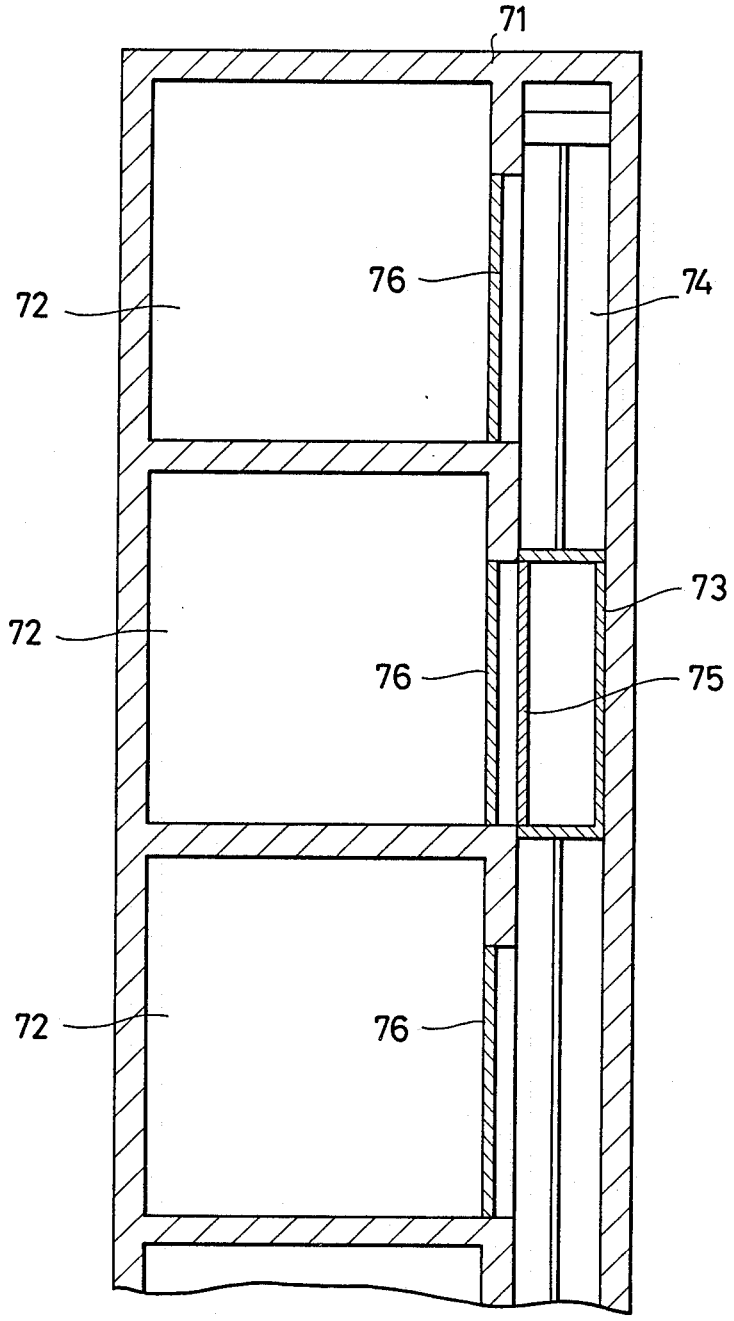
FIG. 10 PRIOR ART
FIG. 10 is a cross-sectional drawing of a building structure of the prior art.
Figure 11:
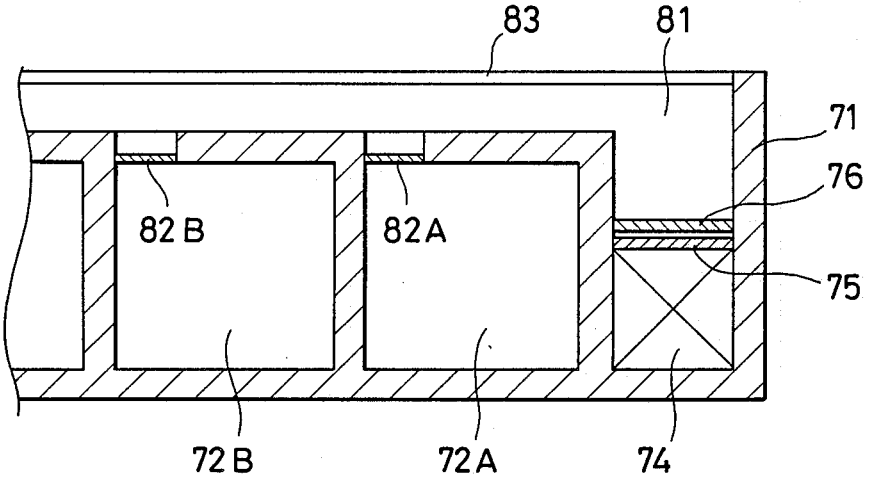
FIG.11 PRIOR ART
FIG. 11 is a cross-sectional drawing of another building structure of the prior art.

FIGS. 9A and 9B show the fourth embodiment of the invention. In the embodiments described above, escalator 91 is positioned in the longitudinal (or connecting) direction of path 39, but in the embodiment shown in FIGS. 9A and 9B, escalator 91 is directed to the side walls of path 39 (in the direction perpendicular to the connecting direction). Also in this case, entrance 92 locates near exit 93 between opening 34 and section 2. This structure can be employed when path 39 is relatively wide. Since in this embodiment and that shown in FIG. 6 people can escape by not passing through section 1, higher safety is maintained. When on each floor in section 2, there can be provided sufficiently wide elevator hall which is connected to living area 11 through path 39, escalator 91 can be positioned in the elevator hall in section 2.

What is claimed is:

1. A multi-level building structure with at least one elevator, said structure comprising:

a first section on each floor having at least one living area in which people work or live, a second section on each floor through which at least one elevator shaft passes, said elevator shaft containing said elevator which passes therethrough, and an elevator entrance, said second section being separated from said first section by a predetermined distance, a third section on each floor having at least one path connecting the living area in the first section and the elevator entrance in the second section, the third section having walls, a floor and a ceiling, the third section having a space over the ceiling having no side walls and being connected directly to the outdoors and separating the second section from the first section so that the first and second sections are connected only through the third section, closable ventilation means on each floor formed at least on the ceiling of the path between the living area in the first section and the elevator entrance in the second section so that the path is connected directly to the outdoors through the space over the ceiling, in case of fire, the smoke and gas from the fire in the first section are exhausted before reaching the elevator entrance and people can safely wait to get on the elevator between said ventilation means and the elevator entrance, and closing means associated with said ventilation means for closing said ventilation means so that the path is not open to the outdoors under normal conditions and is opened automatically in case of fire so that the smoke and gas from the fire are exhausted via said ventilation means.

2. A building structure according to claim 1, wherein the building structure further comprises a first equipment for exhausting the smoke in the elevator to the elevator shaft in case of fire.

3. A building structure according to claim 2, wherein the building structure further comprises a second equipment for exhausting the smoke in the elevator shaft to the outdoors in case of fire.

4. A building structure according to claim 1, wherein the building structure further comprises a nozzle which is mounted in the path between the opening means and the elevator entrance and forms an air curtain.

5. A building structure according to claim 1, wherein the building structure further comprises a door which is located in the path between the first section and the ventilation means and which prevents ingress of smoke into the path when closed so that the path can be used as a safety place at the time of fire.

6. A building structure according to claim 1, wherein the side walls of path have at least one window between the ventilation means and the elevator entrance, the window capable of being opened by hand at the time of fire.

7. A building structure according to claim 1, wherein the building structure further comprises detecting means for detecting the fire and a motor for driving the closing means in accordance with the output of detecting means.

8. A building structure according to claim 7, wherein the detecting means is mounted in the path.

9. A building structure according to claim 7, wherein when the detecting means detects the fire, the closing means only on the floors on and above the floor on which the fire is detected are opened.

10. A building structure according to claim 7, wherein the closing means only on a predetermined number of floors including the floor on which the fire is detected is opened.

11. A building structure according to claim 1, wherein the second section has a power source circuit separated from a power source system in the first section.

12. A building structure according to claim 1, wherein the building structure further comprises escalators each of which connects an upstairs escalator entrance or exit in the first section and a downstairs escalator exit or entrance in the path.

13. A building structure according to claim 12, wherein the escalators have the walls and floor which are connected each other in a form of a tunnel.

14. A building structure according to claim 1, wherein the building structure further comprises escalators each of which connects an escalator entrance and an escalator exit both of which are positioned in the path between the second section and the ventilation means.

15. A building structure according to claim 1, wherein the building structure further comprises escalators each of which connects an escalator entrance and an escalator exit both of which are positioned in the second section.

* * * * *